US007308943B2

(12) United States Patent
Hopper et al.

(10) Patent No.: US 7,308,943 B2
(45) **Date of Patent: *Dec. 18, 2007**

(54) WELL OPERATIONS SYSTEM

(75) Inventors: Hans Paul Hopper, Aberdeen (GB); Thomas G. Cassity, Surrey (GB)

(73) Assignee: Cameron International Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/459,828

(22) Filed: Jul. 25, 2006

(65) Prior Publication Data

US 2006/0272823 A1 Dec. 7, 2006

Related U.S. Application Data

(60) Division of application No. 11/078,121, filed on Mar. 10, 2005, now Pat. No. 7,117,945, and a division of application No. 11/077,587, filed on Mar. 10, 2005, and a division of application No. 10/844,871, filed on May 13, 2004, now Pat. No. 6,991,039, and a division of application No. 10/366,173, filed on Feb. 13, 2003, now Pat. No. 7,093,660, which is a continuation of application No. 09/657,018, filed on Sep. 7, 2000, now Pat. No. 6,547,008, which is a continuation of application No. 09/092,549, filed on Jun. 5, 1998, now abandoned, which is a division of application No. 08/679,560, filed on Jul. 12, 1996, now Pat. No. 6,039,119, which is a continuation of application No. 08/204,397, filed on Mar. 16, 1994, now Pat. No. 5,544,707.

(51) Int. Cl.
*E21B 33/043* (2006.01)

(52) U.S. Cl. ..... 166/348; 166/88.4; 166/89.1; 166/95.1; 166/368

(58) Field of Classification Search ..... 166/348, 166/368, 95.1, 89.1, 88.4, 379
See application file for complete search history.

(56) References Cited

U.S. PATENT DOCUMENTS 2,094,812 A * 10/1937 Penick et al. ..... 166/86.3
2,118,094 A * 5/1938 McDonough et al. ..... 166/87.1
2,148,360 A * 2/1939 Lemley ..... 166/88.1
2,590,688 A * 3/1952 Crain ..... 166/91.1

(Continued)

FOREIGN PATENT DOCUMENTS

EP 0 489 142 1/1997

(Continued)

OTHER PUBLICATIONS

Kvaerner Opposition EP 0719905 with exhibits; Nov. 29, 2001 (pp. 232).

(Continued)

*Primary Examiner*—Hoang Dang
(74) *Attorney, Agent, or Firm*—Conley Rose, P.C.

(57) ABSTRACT

A wellhead has, instead of a conventional Christmas tree, a spool tree in which a tubing hanger is landed at a predetermined angular orientation. As the tubing string can be pulled without disturbing the tree, many advantages follow, including access to the production casing hanger for monitoring production casing annulus pressure, and the introduction of larger tools into the well hole without breaching the integrity of the well.

27 Claims, 16 Drawing Sheets

U.S. PATENT DOCUMENTS

| | | | | | |
|---|---|---|---|---|---|
| 2,889,886 | A | * | 6/1959 | Gould | 166/89.3 |
| 2,965,174 | A | * | 12/1960 | Haeber | 175/8 |
| 3,041,090 | A | * | 6/1962 | Newman et al. | 285/123.2 |
| 3,043,371 | A | * | 7/1962 | Rector | 166/97.1 |
| 3,064,735 | A | * | 11/1962 | Bauer et al. | 166/340 |
| 3,090,640 | A | * | 5/1963 | Otteman et al. | 285/3 |
| 3,098,525 | A | * | 7/1963 | Haeber | 166/348 |
| 3,139,932 | A | * | 7/1964 | Johnson | 166/368 |
| 3,236,308 | A | * | 2/1966 | Leake | 166/338 |
| 3,279,536 | A | * | 10/1966 | Wakefield, Jr. | 166/348 |
| 3,295,600 | A | * | 1/1967 | Brown et al. | 166/348 |
| 3,299,958 | A | * | 1/1967 | Todd | 166/89.2 |
| 3,310,107 | A | * | 3/1967 | Yancey | 166/348 |
| 3,331,437 | A | * | 7/1967 | Jones | 166/368 |
| 3,332,481 | A | * | 7/1967 | Wakefield, Jr. | 166/344 |
| 3,414,056 | A | * | 12/1968 | Brown et al. | 166/135 |
| 3,437,149 | A | * | 4/1969 | Cugini et al. | 166/379 |
| 3,454,084 | A | * | 7/1969 | Sizer | 166/335 |
| 3,457,992 | A | * | 7/1969 | Brown | 166/335 |
| 3,542,125 | A | * | 11/1970 | Sizer | 166/340 |
| 3,545,541 | A | * | 12/1970 | DeVries | 166/95.1 |
| 3,552,903 | A | * | 1/1971 | Townsend | 166/356 |
| 3,602,303 | A | * | 8/1971 | Blenkarn et al. | 166/360 |
| 3,638,725 | A | * | 2/1972 | Ahlstone | 166/330 |
| 3,638,732 | A | * | 2/1972 | Huntsinger et al. | 166/379 |
| 3,662,822 | A | * | 5/1972 | Wakefield, Jr. | 166/335 |
| 3,971,576 | A | | 7/1976 | Herd et al. | |
| 4,053,023 | A | * | 10/1977 | Herd et al. | 175/7 |
| 4,116,044 | A | * | 9/1978 | Garrett | 73/40.5 R |
| 4,130,161 | A | * | 12/1978 | Jones | 166/337 |
| 4,154,302 | A | * | 5/1979 | Cugini | 166/378 |
| 4,289,199 | A | * | 9/1981 | McGee | 166/65.1 |
| 4,491,176 | A | * | 1/1985 | Reed | 166/66.4 |
| 4,629,003 | A | * | 12/1986 | Baugh | 166/341 |
| 4,887,672 | A | | 12/1989 | Hynes | |
| 4,903,774 | A | * | 2/1990 | Dykes et al. | 166/363 |
| 5,092,401 | A | * | 3/1992 | Heynen | 166/89.1 |
| 5,280,766 | A | * | 1/1994 | Mohn | 166/368 |
| 5,372,199 | A | * | 12/1994 | Cegielski et al. | 166/368 |
| 5,544,707 | A | * | 8/1996 | Hopper et al. | 166/382 |
| 5,884,706 | A | * | 3/1999 | Edwards | 166/335 |
| 6,039,119 | A | * | 3/2000 | Hopper et al. | 166/368 |

FOREIGN PATENT DOCUMENTS

| | | | |
|---|---|---|---|
| EP | 0 572 732 | | 8/1998 |
| EP | 0 989 283 | | 3/2000 |
| EP | 0 719 905 | | 2/2001 |
| GB | 2166775 | * | 5/1986 |
| GB | 2192921 | | 1/1988 |
| WO | WO 86/01852 | | 3/1986 |
| WO | WO 92/00438 | | 1/1992 |

OTHER PUBLICATIONS

FMC Opposition EP 0719905 with exhibits; Dec. 5, 2001 (pp. 128).
Cameron Response to FMC Opposition; Jun. 18, 2002; (pp. 14).
Cameron Response to Kvaerner Opposition with Scott Depo. Exhibit; Jun. 18, 2002; (pp. 29).
FMC Reply to Cameron Response; Jun. 17, 2003; (pp. 13).
EPO Preliminary Opinion; Feb. 16, 2005; (pp. 14.
Decision Rejecting the Opposition to EP 0 719 905 (Article 102(2) EPC); Dated Aug. 5, 2005; (pp. 22).
Minutes of the Oral proceedings before the Opposition Division EP 0 719 905 with colored exhibit dated Aug. 5, 2005; (pp. 11).
*Cameron International Corporation* v. *Dril-Quip, Inc.*; C.A. No. 06-728; Amended Complaint for Patent Infringement dated Mar. 16, 2007; (pp. 5).
*Cameron International Corporation* v. *Dril-Quip, Inc.*; C.A. No. 06-728; Defendant Dril-Quip, Inc's Answer, Defenses, and Counterclaims in Response to Plaintiff's Amended Complaint for Patent Infringement dated Apr. 4, 2007.
*Cameron International Corporation* v. *Dril-Quip, Inc.*; C.A. No. 06-728; Plaintiff Cameron International Corporation's Answer to Defendant Dril-Quip, Inc.'s Counterclaims; with Exhibit A, U.S. Patent 6,039,119 (pp. 68) dated Apr. 25, 2007.
Decision Rejecting The Opposition to European Patent EP 0 572 732 Dated Mar. 19, 2002 (pp. 14).
Scott, Peter A. Depo. Upon Written Questions, vol. 1, pp. 1-21 dated Jan. 8, 2003.
Written Submissions before oral proceedings on Jun. 29, 2005 for Opposition to EP 0 719 905 with Exhibits K9-K21 dated Apr. 29, 2005 (pp. 27).
Deposition of Sigbjorn Sangesland (pp. 79-85, 301-317 dated Oct. 27, 1999 (pp. 25).
Declaration of Sigbjorn Sangesland (undated) (pp. 14).
Declaration of Michael Capesius (pp. 10) with Exhibits A-H; dated May 5, 2003.
Subsea 91 International conference; Delegate & Exhibitor List; Undated (pp. 7).
Declaration of Peter Scott (pp. 7); with Exhibits A-G dated May 8, 2003 (pp. 37).
Deposition of James Reid dated Apr. 30, 2003; (pp. 105).
Deposition of Michael Coulthard dated Apr. 25, 2003 (pp. 1-53).
Deposition of David Lorimer dated Apr. 23, 2003 (pp. 1-57).
Deposition of Frank Close dated Apr. 24, 2003; (pp. 22).
Deposition of Stephen A. Hatton dated May 7, 1998 (pp. 1-40).
Decision dated May 14, 2002; from United States Court of Appeals (pp. 15).
Deposition of Hans Hopper, vol. II, dated Jan. 19, 1998; (pp. 229-452).
Deposition of Peter Scott, vol. 1, dated Sep. 18, 1998; (pp. 1-44).
Written Submissions of Patentee Cooper Cameron in reply to Preliminary Opinion of the Opposition Division with Exhibits dated Apr. 29, 2005; (pp. 22).
Deposition of Peter Scott, vol. 1, Sep. 18, 1998 (pp. 12).
Findings of Fact, Conclusions of Law, and Order Findings of Fact dated Jan. 25, 2005 (pp. 25).
EPO Declaration of Mark Carter; dated Apr. 28, 2005 (pp. 13).
Sangesland; Norwegian Institute of Technology, Trondheim, *Electric Submersible Pump for Subsea Completed Wells*; Dated Nov. 26-27, 1991; (pp. 14).
Mathias Owe, The Norwegian Institute of Technology, Trondheim, Dec. 1991; (pp. 149).
Deposition of Sigbjorn Sangesland; dated Oct. 28, 1999; (pp. 17).
Notice of Appeal of Rejection of Opposition to EP 0 719 905 dated Oct. 20, 2005 with Statement of Grounds of Appeal dated Dec. 9, 2005; (pp. 15).
Statement of Patentee In Reply to Opponent's Statement of Grounds for Appeal of the Decision Upholding EP 0 719 905, dated Jun. 30, 2006 (pp. 25).
Opponent's Response to Patentee's Reply to Opponent's Statement of Grounds of Appeal, dated Nov. 17, 2006.
Huber, et al; SPE 13976/1; *Through Bore Subsea Christmas Trees*; (Copyright 1985); Dated Sep. 10-13, 1985.
SPE 23050 P.A. Scott, M. Bowring, B. Coleman; *Electrical Submersible Pumps in Subsea Completions*; Sep. 3-6, 1991; (pp. 7).
OTC 5689; D. S. Huber et al., *The Subsea Systems of the Argyll Area Fields*; Dated May 2-5, 1988; (pp. 10).
D. S. Huber et al.; *The Development of the 7-1/16" Through-Bore Christmas Treei*; (Undated), (pp. 8).
Underwater Technology Conference; Dated 1990; *Subsea Production Systems: The Search for Cost-Effective Technology*; Dated Mar. 19-21, 1990 (pp. 15).
Sigbjorn Sangesland; Subsea Production Technology; *Simplified Subsea System Design*; Dated Oct. 23-27 and Nov. 20-24, 1989; (pp. 32).
Kvaerner Notice of Opposition filed against EP Patent 0 989 283 dated May 14, 2003 (pp. 23).
FMC Technologies Limited Opposition to EP Patent 0 989 283 dated May 13, 2005 with Annex 1 and 2.

ABB Vetco Gray's Notice of Opposition to EP Patent 0 989 283 dated May 8, 2003 (pp. 39).
Headworth, Colin, et al.; Advances in Underwater Technology, Ocean Science and Offshore Engineering, vol. 20, Second Generation; *Advances in Riserless Intervention for Subsea Well Servicing*; 1989; (pp. 11-18).
Hopper, C. T.; SPIE 18239, *Simultaneous Wireline Operations From a Floating Vessel Using a Subsea Lubricator*; Society of Petroleum Engineers; Oct. 2-5, 1988; (pp. 23-30).
Stipulation Regarding the Agreed Definition of the Terms Workover Port, Workover Passageway, and Workover Flowpath in United States Patent Nos. 5,544,707 and 6,039,119 (pp. 1), Feb. 5, 2001.
American Petroleum Institute, Petroleum Industry Data Exchange (PIDX) Committee; *PIDX Petroleum Industry Data Dictionary* (*PIDD*); dated May 7, 2003; (pp. 4).
Deposition of Hans Paul Hopper dated Jan. 21, 1998 (pp. 453-693).

* cited by examiner

WELL OPERATIONS SYSTEM

CROSS-REFERENCE TO RELATED APPLICATIONS

This is a divisional application of application Ser. No. 11/078,121 filed Mar. 10, 2005 now U.S. Pat. No. 7,117,945, Ser. No. 11/077,587 filed Mar. 10, 2005, Ser. No. 10/844,871 filed May 13, 2004 now U.S. Pat. No. 6,991,039, and Ser. No. 10/366,173 filed Feb. 13, 2003 now U.S. Pat. No. 7,093,660, which is a continuation of application Ser. No. 09/657,018 filed Sep. 7, 2000, now U.S. Pat. No. 6,547,008, which is a continuation of application Ser. No. 09/092,549 filed Jun. 5, 1998 now abandoned, which is a divisional continuing application of Ser. No. 08/679,560 filed Jul. 12, 1996, now U.S. Pat. No. 6,039,119, which is a continuation of Ser. No. 08/204,397 filed Mar. 16, 1994, now U.S. Pat. No. 5,544,707, which claims the benefit of PCT application PCT/US93/05246 filed on May 28, 1993, which claims the priority of European Patent Office application 92305014 filed on Jun. 1, 1992, all of the above hereby incorporated herein by reference.

STATEMENT REGARDING FEDERALLY SPONSORED RESEARCH OR DEVELOPMENT

Not Applicable.

FIELD OF THE INVENTION

Conventionally, wells in oil and gas fields are built up by establishing a wellhead housing, and with a drilling blow out preventer stack (BOP) installed, drilling down to produce the well hole whilst successively installing concentric casing strings, which are cemented at the lower ends and sealed with mechanical seal assemblies at their upper ends. In order to convert the cased well for production, a tubing string is run in through the BOP and a hanger at its upper end landed in the wellhead. Thereafter the drilling BOP stack is removed and replaced by a Christmas tree having one or more production bores containing actuated valves and extending vertically to respective lateral production fluid outlet ports in the wall of the Christmas tree.

This arrangement has involved problems which have, previously, been accepted as inevitable. Thus any operations down hole have been limited to tooling which can pass through the production bore, which is usually no more than five inch diameter, unless the Christmas tree is first removed and replaced by a BOP stack. However this involves setting plugs or valves, which may be unreliable by not having been used for a long time, down hole. The well is in a vulnerable condition whilst the Christmas tree and BOP stack are being exchanged and neither one is in position, which is a lengthy operation. Also, if it is necessary to pull the completion, consisting essentially of the tubing string on its hanger, the Christmas tree must first be removed and replaced by a BOP stack. This usually involves plugging and/or killing the well.

A further difficulty which exists, particularly with subsea wells, is in providing the proper angular alignment between the various functions, such as fluid flow bores, and electrical and hydraulic lines, when the wellhead equipment, including the tubing hanger, Christmas tree, BOP stack and emergency disconnect devices are stacked up. Exact alignment is necessary if clean connections are to be made without damage as the devices are lowered into engagement with one another. This problem is exacerbated in the case of subsea wells as the various devices which are to be stacked up are run down onto guide posts or a guide funnel projecting upwardly from a guide base. The post receptacles which ride down on to the guide posts or the entry guide into the funnel do so with appreciable clearance. This clearance inevitably introduces some uncertainty in alignment and the aggregate misalignment when multiple devices are stacked, can be unacceptably large. Also the exact orientation will depend upon the precise positions of the posts or keys on a particular guide base and the guides on a particular running tool or BOP stack and these will vary significantly from one to another. Consequently it is preferable to ensure that the same running tools or BOP stack are used for the same wellhead, or a new tool or stack may have to be specially modified for a particular wellhead. Further "misalignment" can arise from the manner in which the guide base is bolted to the conductor casing of the wellhead.

In accordance with the present invention, a wellhead comprises a wellhead housing; a spool tree fixed and sealed to the housing, and having at least a lateral production fluid outlet port connected to an actuated valve; and a tubing hanger landed within the spool tree at a predetermined angular position at which a lateral production fluid outlet port in the tubing hanger is in alignment with that in the spool tree.

With this arrangement, the spool tree, takes the place of a conventional Christmas tree but differs therefrom in having a comparatively large vertical through bore without any internal valves and at least large enough to accommodate the tubing completion. The advantages which are derived from the use of such spool tree are remarkable, in respect to safety and operational benefits.

Thus, in workover situations the completion, consisting essentially of the tubing string, can be pulled through a BOP stack, without disturbing the spool tree and hence the pressure integrity of the well, whereafter full production casing drift access is provided to the well through the large bore in the spool tree. The BOP can be any appropriate workover BOP or drilling BOP of opportunity and does not have to be one specially set up for that well.

Preferably, there are complementary guide means on the tubing hanger and spool tree to rotate the tubing hanger into the predetermined angular position relatively to the spool tree as the tubing hanger is lowered on to its landing. With this feature the spool tree can be landed at any angular orientation onto the wellhead housing and the guide means ensures that the tubing string will rotate directly to exactly the correct angular orientation relatively to the spool tree quite independently of any outside influence. The guide means to control rotation of the tubing hanger into the predetermined angular orientation relatively to the spool tree may be provided by complementary oblique edge surfaces one facing downwardly on an orientation sleeve depending from the tubing hanger the other facing upwardly on an orientation sleeve carried by the spool tree Whereas modern well technology provides continuous access to the tubing annulus around the tubing string, it has generally been accepted as being difficult, if not impossible, to provide continuous venting and/or monitoring of the pressure in the production casing annulus, that is the annulus around the innermost casing string. This has been because the production casing annulus must be securely sealed whist the Christmas tree is fitted in place of the drilling BOP, and the Christmas tree has only been fitted after the tubing string and hanger has been run in, necessarily inside the production casing hanger, so that the production casing hanger is no longer accessible for the opening of a passageway from the production casing annulus. However, the new arrangement, wherein the spool tree is fitted before the tubing string is run in provides adequate protected access through the BOP and spool tree to the production casing hanger for controlling a passage from the production casing annulus.

For this purpose, the wellhead may include a production casing hanger landed in the wellhead housing below the spool tree; an isolation sleeve which is sealed at its lower end to the production casing hanger and at its upper end to the spool tree to define an annular void between the isolation sleeve and the housing; and an adapter located in the annular space and providing part of a passage from the production casing annulus to a production casing annulus pressure monitoring port in the spool tree, the adapter having a valve for opening and closing the passage, and the valve being operable through the spool tree after withdrawal of the isolation sleeve up through the spool tree. The valve may be provided by a gland nut, which can be screwed up and down within a body of the adapter to bring parts of the passage formed in the gland nut and adapter body, respectively, into and out of alignment with one another. The orientation sleeve for the tubing hanger may be provided within the isolation sleeve.

Production casing annulus pressure monitoring can then be set up by method of completing a cased well in which a production casing hanger is fixed and sealed by a seal assembly to a wellhead housing, the method comprising, with BOP installed on the housing, removing the seal assembly and replacing it with an adapter which is manipulatable between configurations in which a passages from the production casing annulus up past the production casing hanger is open or closed; with the passage closed, removing the BOP and fitting to the housing above the production casing hanger a spool tree having an internal landing for a tubing hanger; installing a BOP on the spool tree; running a tool down through the BOP and spool tree to manipulate the valve and open the passage; inserting through the BOP and spool tree an isolation sleeve, which seals to both the production casing and spool tree and hence defines between the sleeve and casing an annular void through which the passage leads to a production caning annulus pressure monitoring port in the spool tree; and running a tubing string down through the BOP and spool tree until the tubing hanger lands in the spool tree with lateral outlet ports in the tubing hanger and spool tree for production fluid flow, in alignment with one another.

According to a further feature of the invention the spool tree has a downwardly depending location mandrel which is a close sliding fit within a bore of the wellhead housing. The close fit between the location mandrel of the spool tree and the wellhead housing provides a secure mounting which transmits inevitable bending stresses to the housing from the heavy equipment, such as a BOP, which projects upwardly from the top of the wellhead housing, without the need for excessively sturdy connections. The location mandrel may be formed as an integral part of the body of the spool tree, or may be a separate part which is securely fixed, oriented and sealed to the body.

Pressure integrity between the wellhead housing and spool tree may be provided by two seals positioned in series one forming an environmental seal (such as an AX gasket) between the spool tree and the wellhead housing, and the other forming a production seal between the location mandrel and either the wellhead housing or the production casing hanger During workover operations, the production casing annulus can be resealed by reversing the above steps, if necessary after setting plugs or packers down hole.

When production casing pressure monitoring is unnecessary, so that no isolation sleeve is required, the orientation sleeve carried by the spool tree for guiding and rotating the tubing hanger down into the correct angular orientation may be part of the spool tree location mandrel itself Double barrier isolation, that is to say two barriers in series, are generally necessary for containing pressure in a well. If a spool tree is used instead of a conventional Christmas tree, there are no valves within the vertical production and annulus fluid flow bores within the tree, and alternative provision must be made for sealing the bore or bores through the top of the spool tree which provide for wire line or drill pipe access.

In accordance with a further feature of the invention, at least one vertical production fluid bore in the tubing hanger is sealed above the respective lateral production fluid outlet port by means of a removable plug, and the bore through the spool tree being sealed above the tubing hanger by means of a second removable plug.

With this arrangement, the first plug, takes the function of a conventional swab valve, and may be a wireline set plug. The second plug could be a stopper set in the spool tree above the tubing hanger by, e.g., a drill pipe running tool. The stopper could contain at least one wireline retrievable plug which would allow well access when only wire line operations are called for. The second plug should seal and be locked internally into the spool tree as it performs a barrier to the well when a BOP or intervention module is deployed A particular advantage of this double plug arrangement is that, as is necessary to satisfy authorities in some jurisdictions, the two independent barriers are provided in mechanically separate parts, namely the tubing hanger and its plug and the second plug in the spool tree.

A further advantage arises if a workover port extends laterally through the wall of the spool tree from between the two plugs; a tubing annulus fluid port extends laterally through the wall of the spool tree from the tubing annulus; and these two ports through the spool tree are interconnected via an external flow line containing at least one actuated valve. The bore from the tubing annulus can then terminate at the port in the spool tree and no wireline access to the tubing annulus bore is necessary through the spool tree as the tubing annulus bore can be connected via the interplug void to choke or kill lines, i.e. a BOP annulus, so that downhole circulation is still available. It is then only necessary to provide wireline access at workover situations to the production bore or bores. This considerably simplifies workover BOP and/or riser construction. When used in conjunction with the plug at the top of the spool tree, the desirable double barrier isolation is provided by the spool tree plug over the tubing hanger, or workover valve from the production flow.

When the well is completed as a multi production bore well, in which the tubing hanger has at least two vertical production through bores each with a lateral production fluid flow port aligned with the corresponding port in the spool tree, at least two respective connectors may be provided for selective connection of a single bore wire line running tool to one or other of the production bores, each connector having a key for entering a complementary formation at the top of the spool tree to locate the connector in a predetermined angular orientation relatively to the spool tree. The same type of alternative connectors may be used for providing wireline or other running tool access to a selected one of a plurality of functional connections, e.g. electrical or hydraulic couplings, at the upper end of the tubing hanger

BRIEF DESCRIPTION OF THE DRAWINGS

The development and completion of a subsea wellhead in accordance with the present invention are illustrated in the accompanying drawings, in which.

DETAILED DESCRIPTION OF THE PREFERRED EMBODIMENTS

Figure 1:
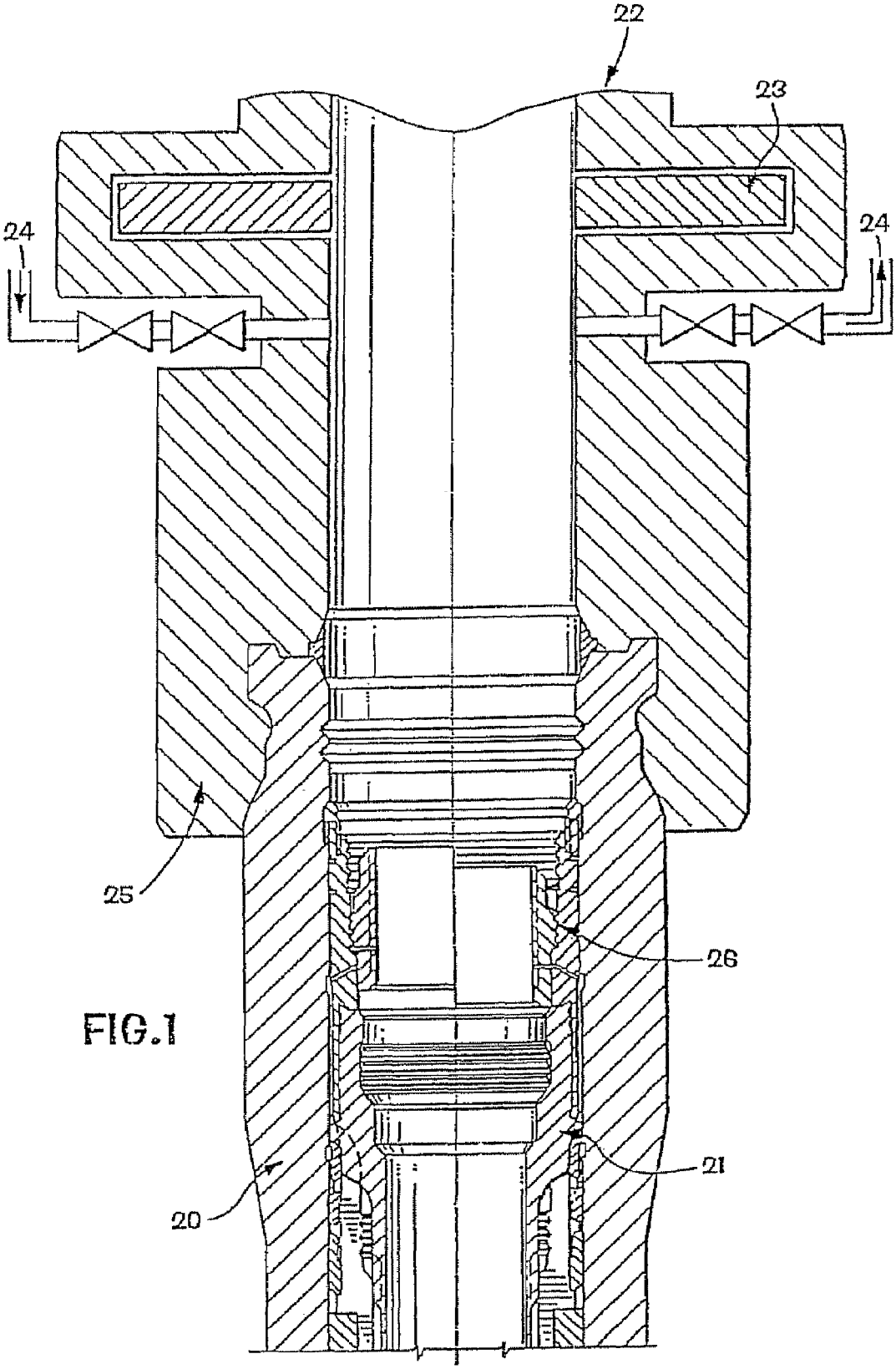
FIGS. 1 to 8 are vertical axial sections showing successive steps in development and completion of the wellhead, the Figure numbers bearing the letter A being enlargements of part of the corresponding Figures of same number without the A.

FIG. 1 shows the upper end of a cased well having a wellhead housing 20, in which casing hangers, including an uppermost production casing hanger 21 for, for example, 9⅝" or 10¾", production casing is mounted in conventional manner FIG. 1 shows a conventional drilling BOP 22 having rams 23 and kill and choke lines 24 connected to the upper end of the housing 20 by a drilling connector 25.

Figure 1A:
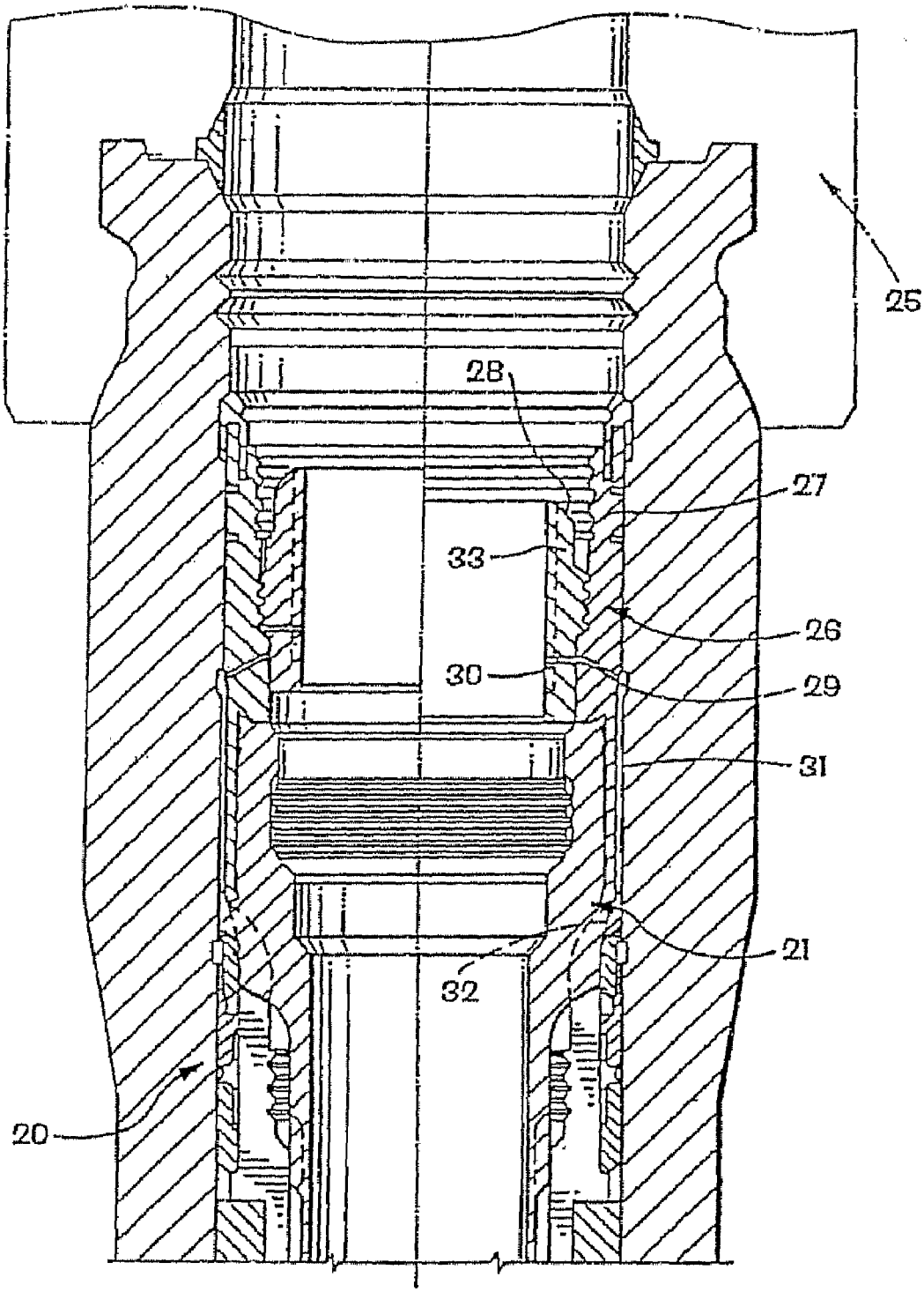

As seen in more detail in FIG. 1A, the usual mechanical seal assemblies between the production casing hanger 21 and the surrounding wellhead housing 20 have been removed and replaced through the BOP with an adapter 26 consisting of an outer annular body part 27 and an inner annular gland nut 28 which has a screw threaded connection to the body 27 so that it can be screwed between a lowered position shown on the right hand side of FIG. 1A, in which radial ducts 29 and 30, respectively in the body 27 and nut 28, are in communication with one another, and a raised position shown on the left hand side of FIG. 1A, in which the ducts are out of communication with one another. The duct 29 communicates through a conduit 31 between a depending portion of the body 27 and the housing 20, and through a conduit 32 passing through the production casing hanger 21, to the annulus surround the production casing. The duct 30 communicates through channels 33 formed in the radially inner surface of the nut 28, and hence to a void to be described. The cooperation between the gland nut 28 and body 27 of the adapter therefore acts as a valve which can open and close a passage up past the production casing hanger from the production casing annulus. After appropriate testing, a tool is run in through the BOP and, by means by radially projecting spring lugs engaging in the channels 33, rotates the gland nut 28 to the valve closed position shown on the right hand side on FIG. 1A. The well is thus resealed and the drilling 10P 22 can temporarily be removed.

Figure 2:
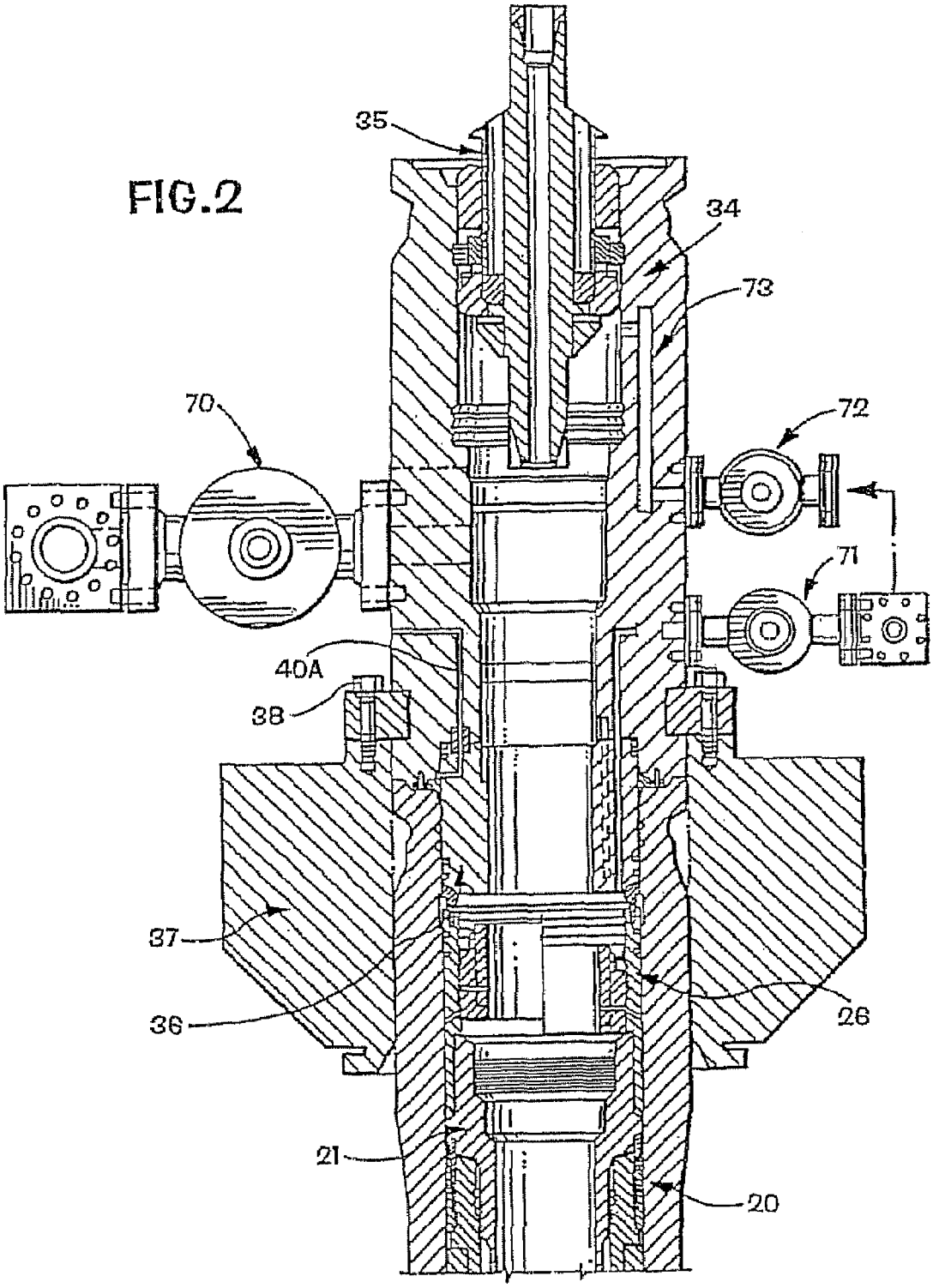
Figure 2A:
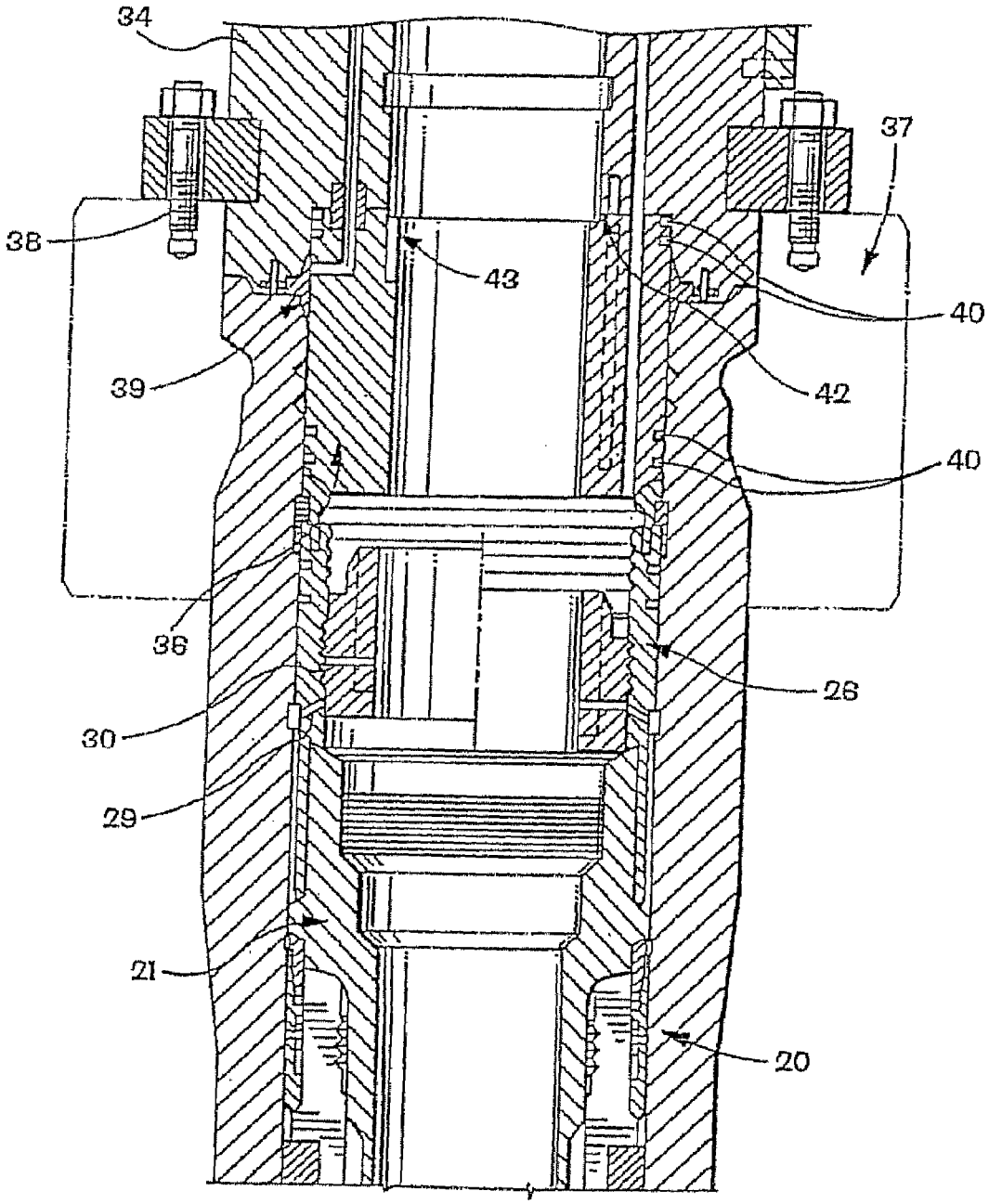

As shown in FIGS. 2 and 2A, the body of a tree spool 34 is then lowered on a tree installation tool 35, using conventional guide post location, or a guide funnel in case of deep water, until a spool tree mandrel 36 is guided into alignment with and slides as a close machined fit, into the upper end of the wellhead housing 20, to which the spool tree is then fixed via a production connector 37 and bolts 48. The mandrel 36 is actually a separate part which is bolted and sealed to the rest of the spool tree body. As seen particularly in FIG. 2A a weight set AX gasket 39, forming a metal to metal environmental seal is provided between the spool tree body and the wellhead housing 20. In addition two sets of sealing rings 40 provide, in series with the environmental seal, a production fluid seal externally between the ends to the spool tree mandrel 36 to the spool tree body and to the wellhead housing 20. The intervening cavity can be tested through a test part 40A. The provision of the adapter 26 is actually optional, and in its absence the lower end of the spool tree mandrel 36 may form a production seal directly with the production casing hanger 21. As is also apparent from reasons which will subsequently become apparent, the upper radially inner edge of the spool tree mandrel projects radially inwardly from the inner surface of the spool tree body above, to form a landing shoulder 42 and at least one machined key slot 43 is formed down through the landing shoulder.

Figure 3:
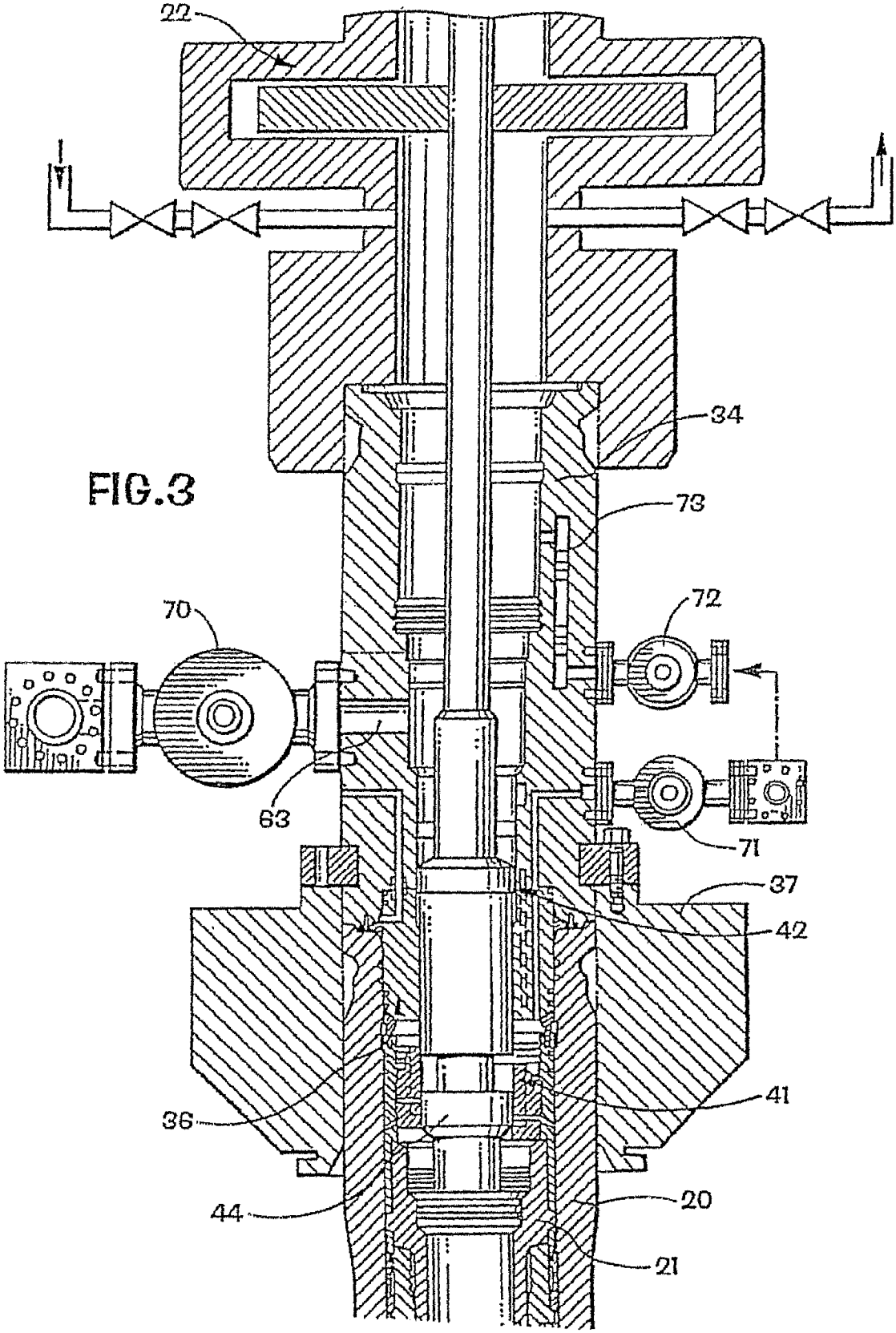
Figure 4:
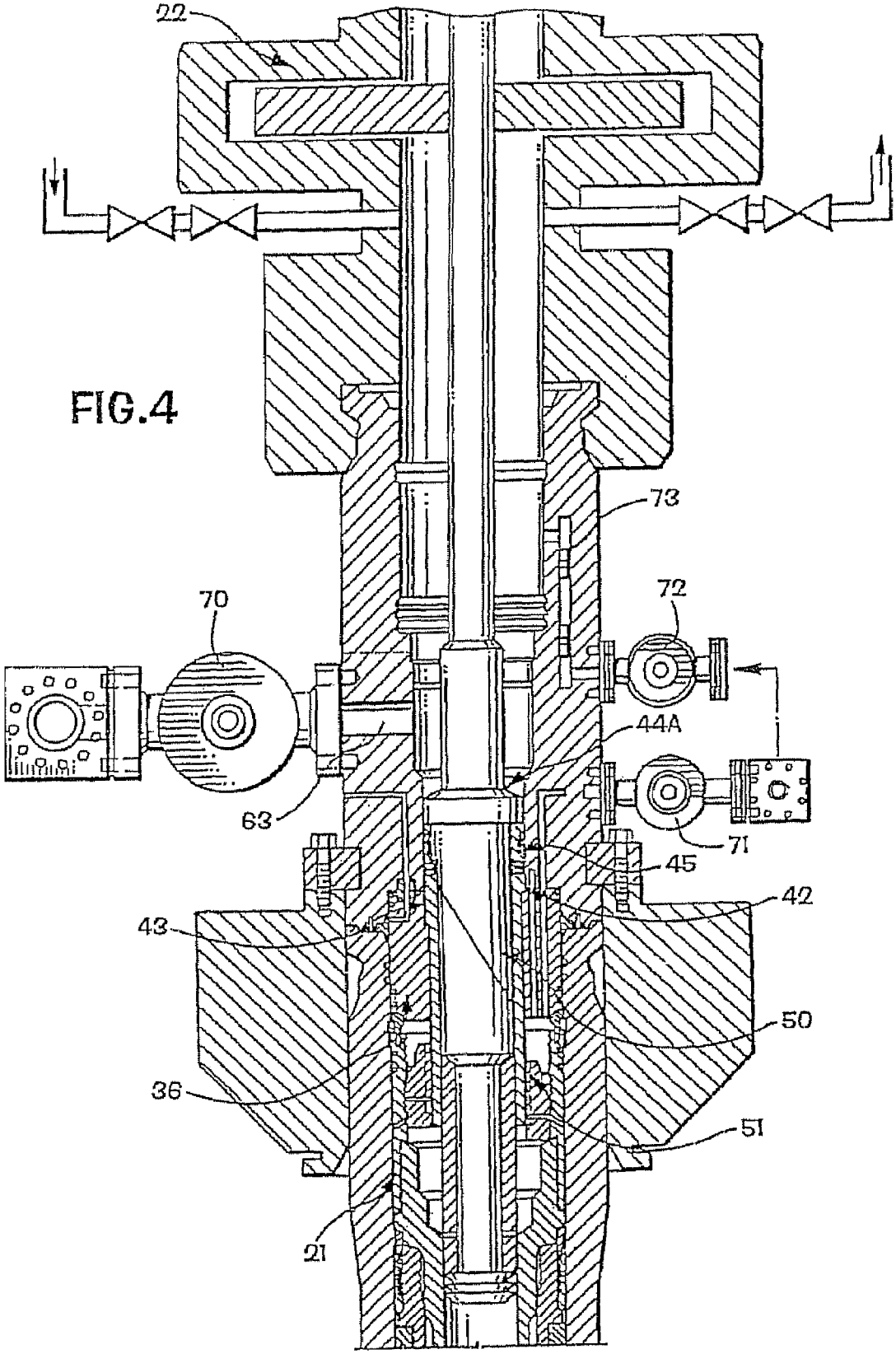
Figure 4A:
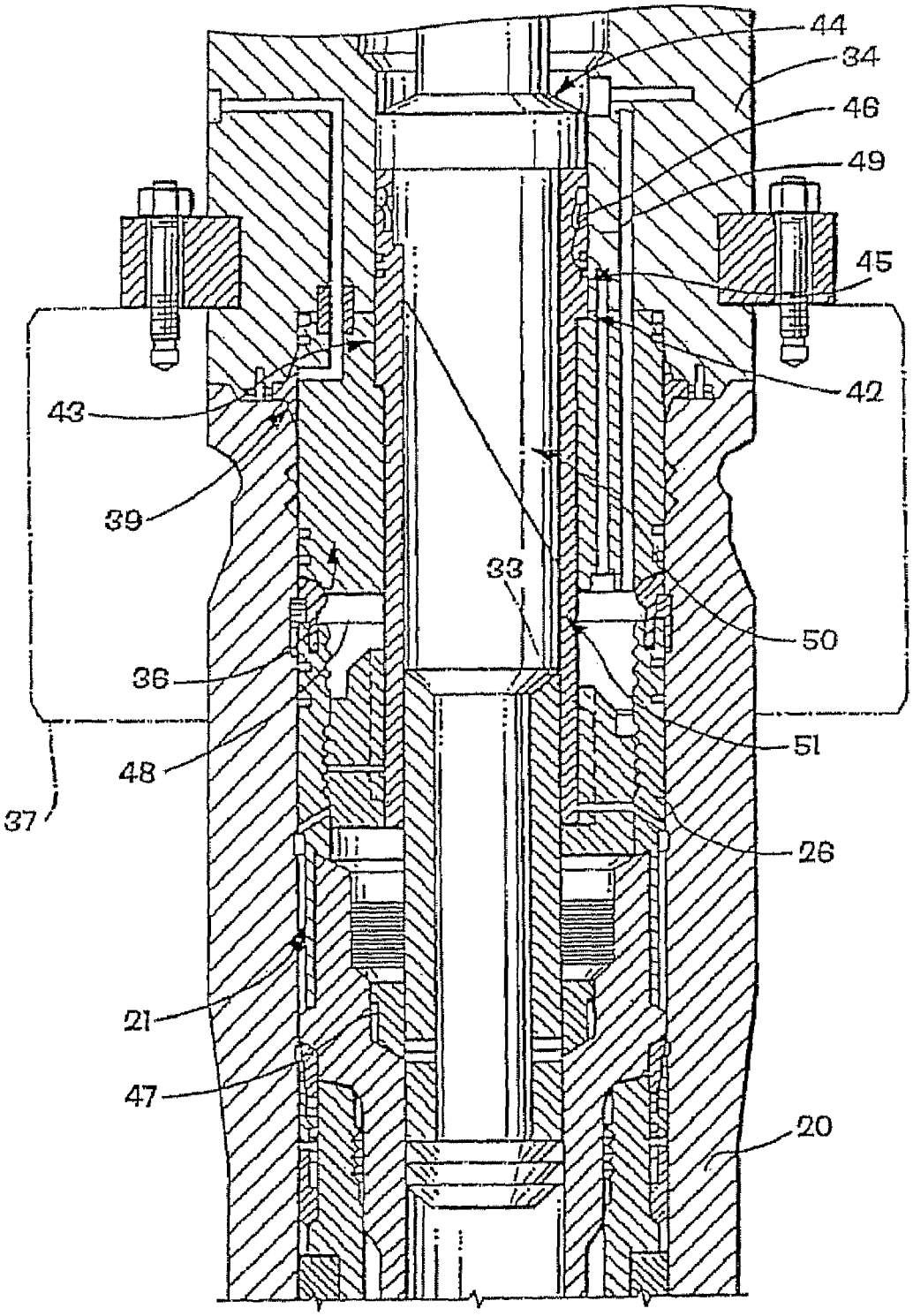

As shown in FIG. 3, the drilling BOP 22 is reinstalled on the spool tree 34. The tool 44 used to set the adapter in FIG. 1, having the spring dogs 45, is again run in until it lands on the shoulder 42, and the spring dogs 45 engage in the channels 33. The tool is then turned to screw the gland nut 28 down within the body 27 of the adapter 26 to the valve open position shown on the right hand side in FIG. 1A. It is now safe to open the production casing annulus as the well is protected by the BOP The next stage, shown in FIGS. 4 and 4A, is to run in through the BOP and spool tree on an appropriate tool 44A a combined isolation and orientation sleeve 45. This lands on the shoulder 42 at the top of the spool tree mandrel and is rotated until a key on the sleeve drops into the mandrel key slot 43. This ensures precise angular orientation between the sleeve 45 and the spool tree 44, which is necessary, and in contrast to the angular orientation between the spool tree 34 and the wellhead casing, which is arbitrary. The sleeve 45 consists of an external cylindrical portion, an upper external surface of which is sealed by ring seals 46 to the spool tree 34, and the lower external surface of which is sealed by an annular seal 47 to the production casing hanger 21. There is thus provided between the sleeve 45 and the surrounding wellhead casing 20 a void 48 with which the channels 33, now defined radially inwardly by the sleeve 45, communicate. The void 48 in turn communicates via a duct 49 through the mandrel and body of the spool tree 34 to a lateral port. It is thus possible to monitor and vent the pressure in the production casing annulus through the passage provided past the production casing hanger via the conduits 32, 31 the ducts 29 and 30, the channels 33, shown in FIG. 1A, the void 48, the duct 49, and the lateral port in the spool tree. In the drawings, the radial portion of the duct 49 is shown apparently communicating with a tubing annulus, but this is draftsman's license and the ports from the two annuli are, in fact, angularly and radially spaced.

Within the cylindrical portion of the sleeve 45 is a lining, which may be fixed in the cylindrical portion, or left after internal machining of the sleeve. This lining provides an orientation sleeve having an upper/edge forming a cam 50. The lowermost portion of the cam leads into a key slot 51.

Figure 5:
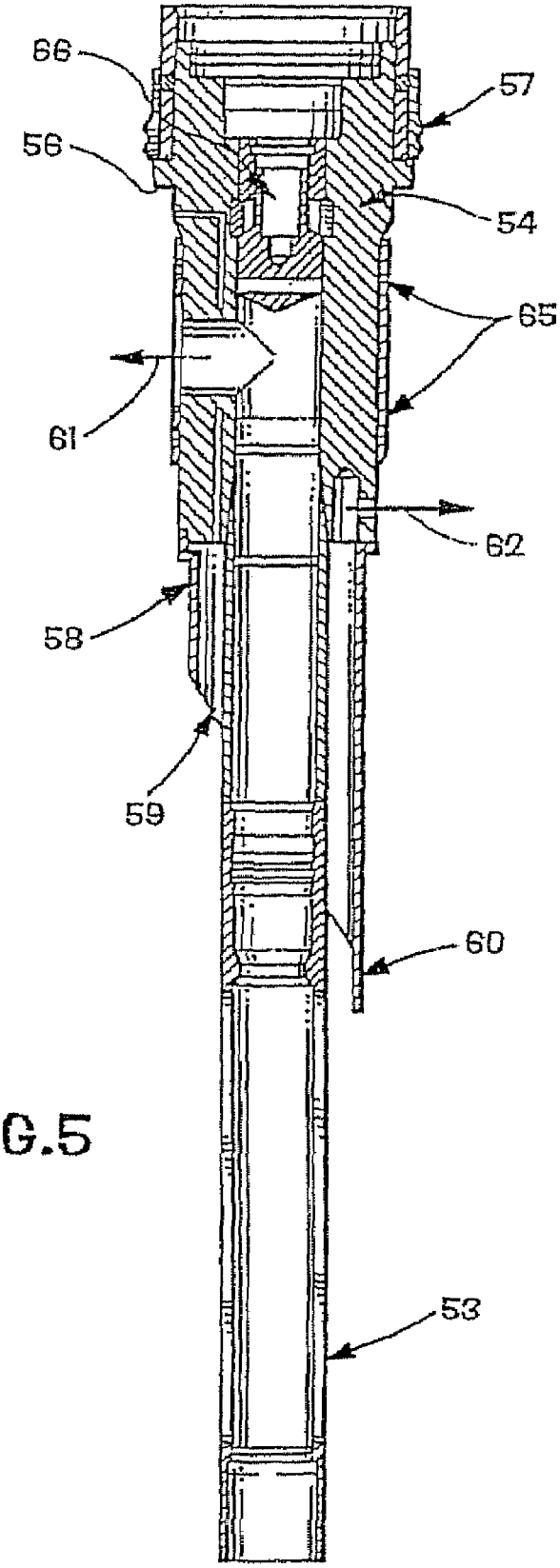
Figure 6:
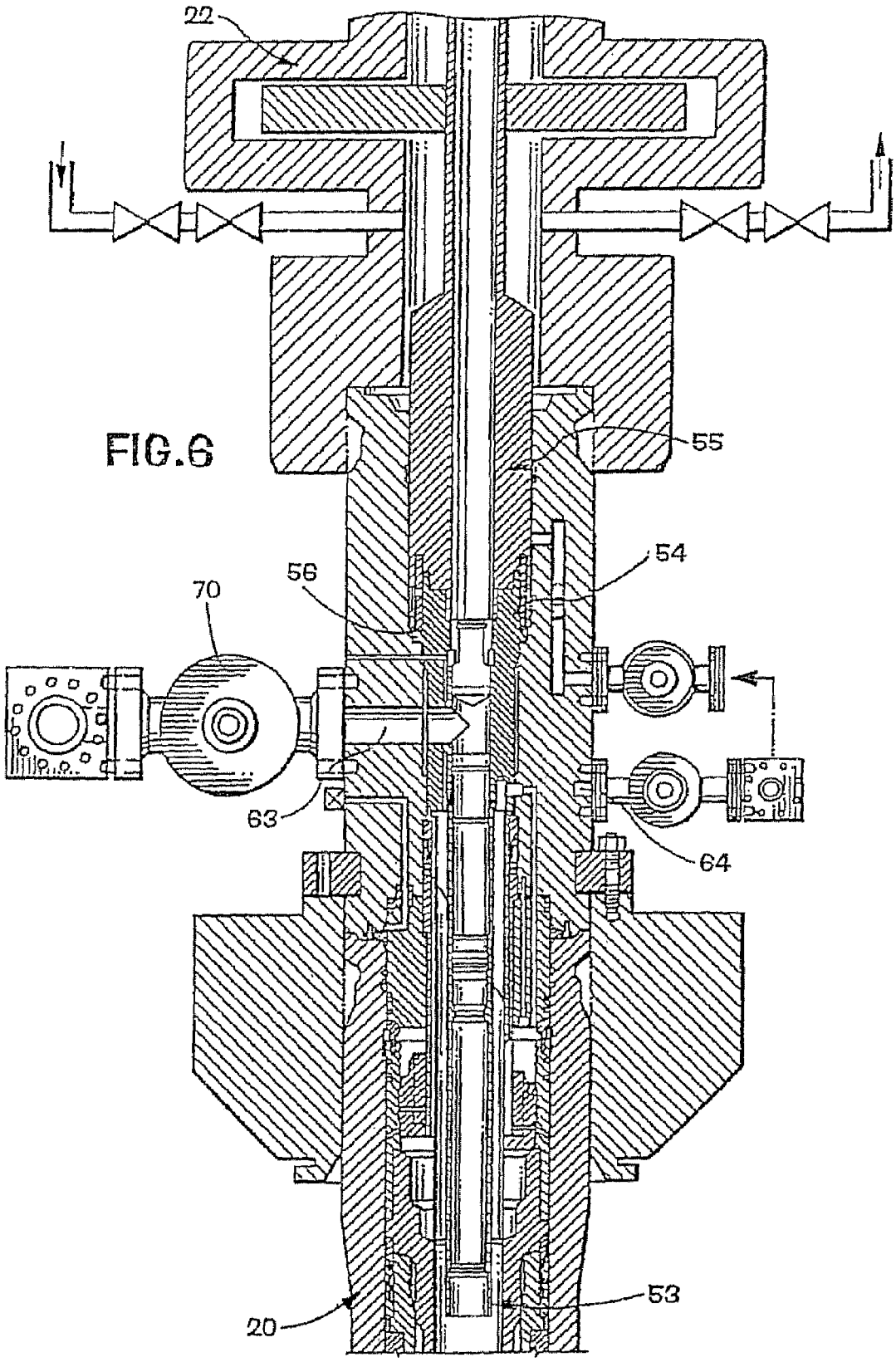
Figure 6A:
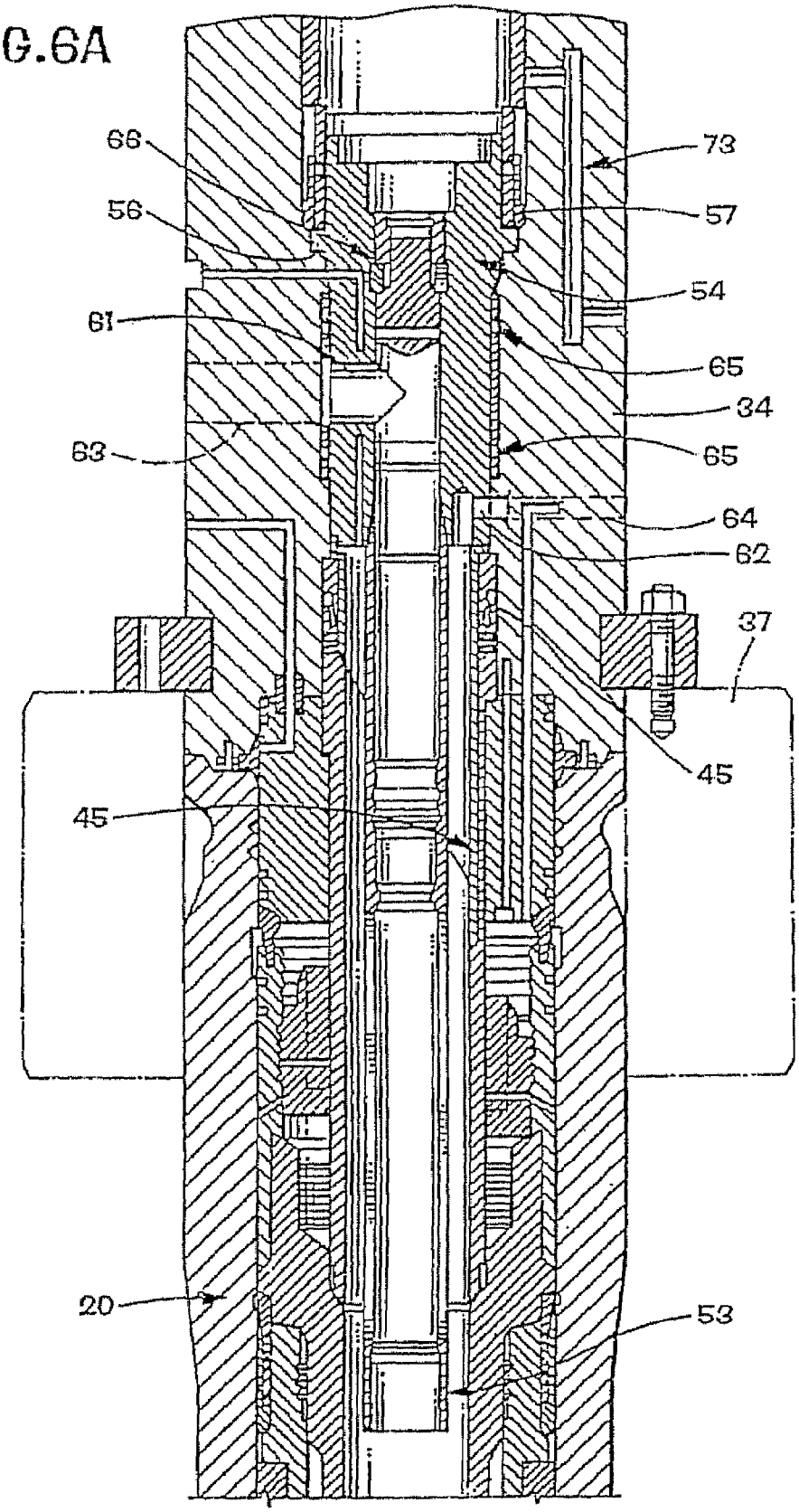

As shown in FIGS. 5, 6 and 6A a tubing string of production tubing 53 on a tubing hanger 54 is run in through the BOP 22 and spool tree 34 on a tool 55 until the tubing hanger lands by means of a keyed shoulder 56 on a landing in the spool tree and is locked down by a conventional mechanism 57. The tubing hanger 54 has a depending orientation sleeve 58 having an oblique lower edge forming a cam 59 which is complementary to the cam 50 in the sleeve 45 and, at the lower end of the cam, a downwardly projecting key 60 which is complementary to the key slot 51. The effect of the cams 50 and 59 is that, irrespective of the angular orientation of the tubing string as it is run in, the cams will cause the tubing hanger 54 to be rotated to its correct angular orientation relatively to the spool tree and the engagement of the key 60 in the key slot 51 will lock this relative orientation between the tubing hanger and spool tree, so that lateral production and tubing annulus fluid flow ports 61 and 62 in the tubing hanger 54 are in alignment with respective lateral production and tubing annulus fluid flow ports 63 and 64 through the wall of the spool tree. Metal to metal annulus seals 65, which are set by the weight of the tubing string, provide production fluid seals between the tubing hanger 54 and the spool tree 34. Provision is made in the top of the tubing hanger 54 for a wireline set plug 66. The keyed shoulder 56 of the tubing hanger lands in a complementary machined step in the spool tree 34 to ensure ultimate machined accuracy of orientation between the tubing hanger 54 and the spool tree 34.

Figure 7:
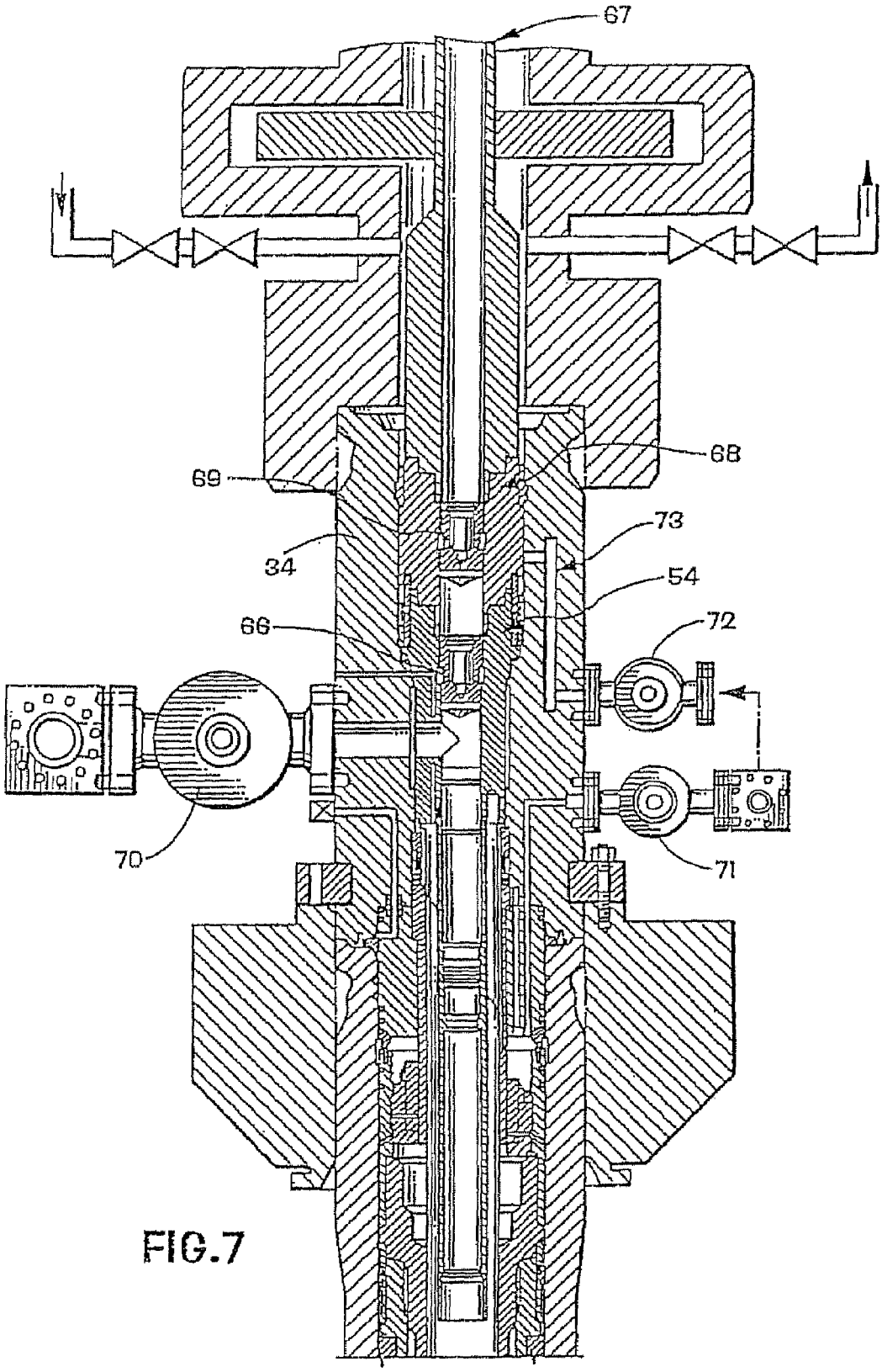

FIG. 7 shows the final step in the completion of the spool tree. This involves the running down on drill pipe 67 through the BOP, an internal isolation stopper 68 which seals within the top of the spool tree 34 and has an opening closed by an in situ wireline activated plug 69. The BOP can then be removed leaving the wellhead in production mode with double barrier isolation at the upper end of the spool tree provided by the plugs 66 and 69 and the stopper 68. The production fluid outlet is controlled by a master control valve 70 and pressure through the tubing annulus outlet ports 62 and 64 is controlled by an annulus master valve 71. The other side of this valve is connected, through a workover valve 72 to a lateral workover port 73 which extends through the wall of the spool tree to the void between the plugs 69 and 66. With this arrangement, wireline access to the tubing annulus in and downstream of a tubing hanger is unnecessary as any circulation of fluids can take place through the valves 71 and 72, the ports 62, 64 and 73, and the kill or choke lines of any BOP which has been installed. The spool tree in the completed production mode is shown in FIG. 8.

Figure 9:
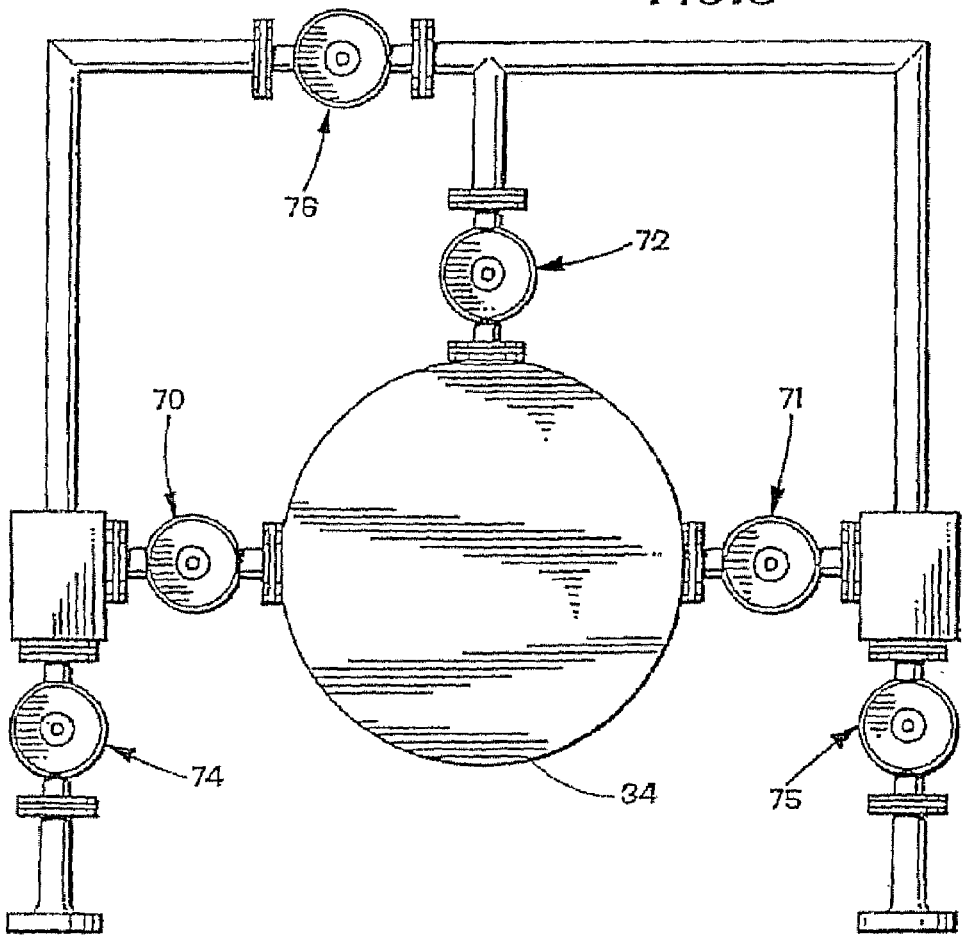
FIG. 9 is a circuit diagram showing external connections to the spool 3.

FIG. 9 shows valve circuitry associated with the completion and, in addition to the earlier views, shows a production fluid isolation valve 74, a tubing annulus valve 75 and a cross over valve 76. With this arrangement a wide variety of circulation can be achieved down hole using the production bore and tubing annulus, in conjunction with choke and kill lines extending from the BOP and through the usual riser string. All the valves are fail/safe closed if not actuated.

The arrangement shown in FIGS. 1 to 9 is a mono production bore wellhead which can be accessed by a single wireline or drill pipe, and the external loop from the tubing annulus port to the void between the two plugs at the top of the spools tree avoids the need for wireline access to the tubing annulus bore.

Figure 8:
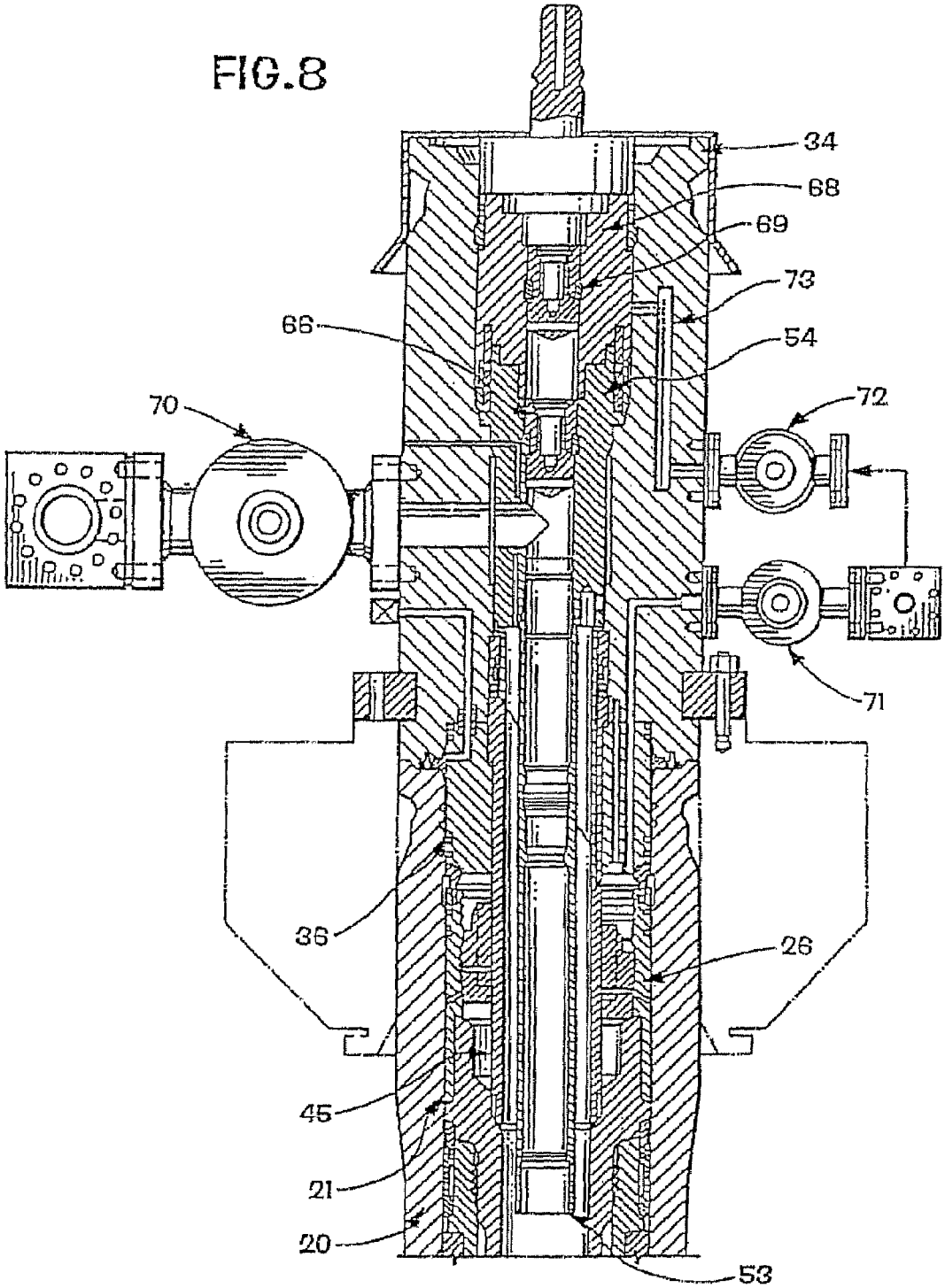
Figure 10:
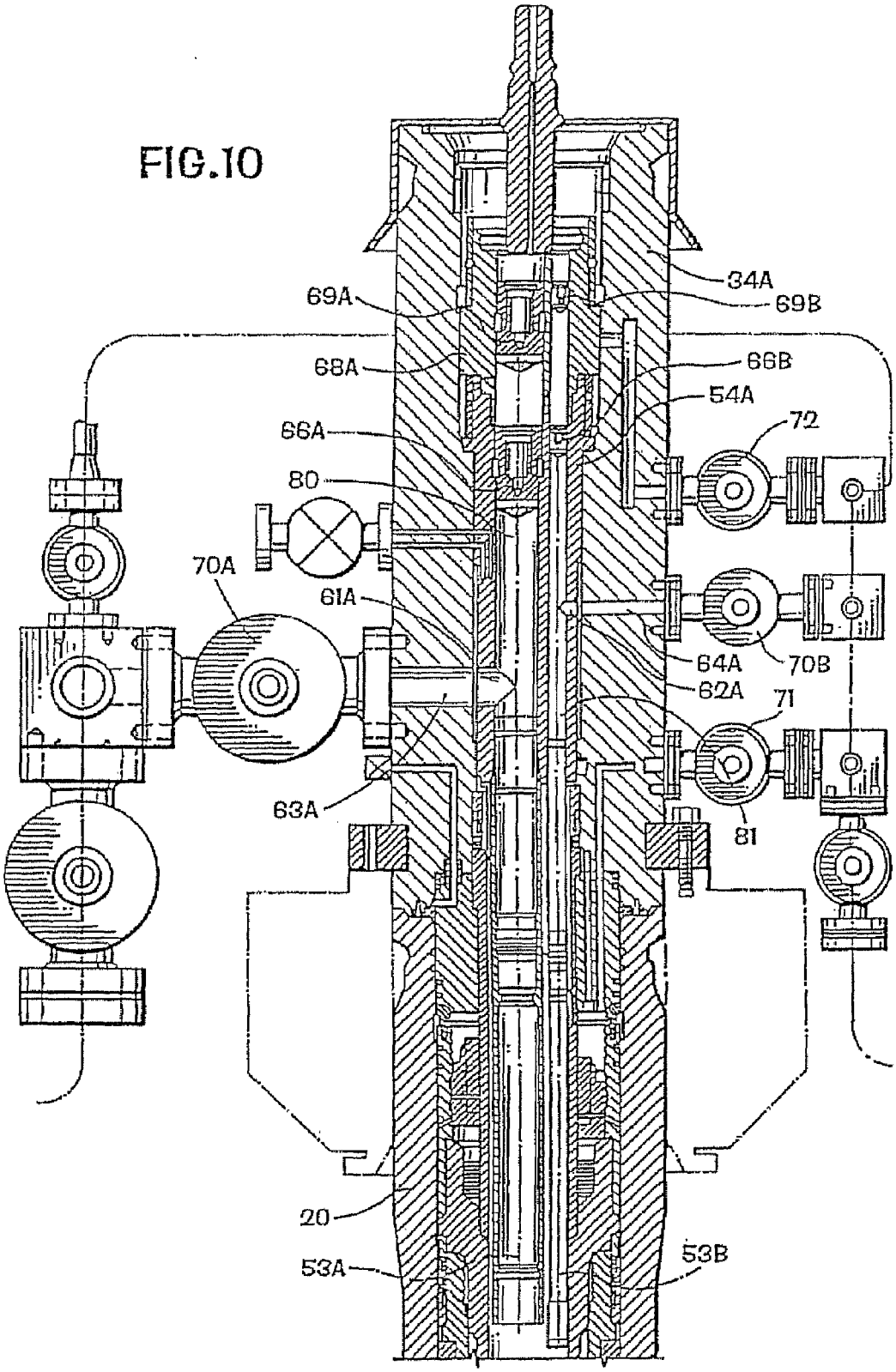
FIG. 10 is a vertical axial section through a completed dual production bore well in production mode.

FIG. 10 corresponds to FIG. 8 but shows a 5½ inch×2⅜ inch dual production bore wellhead with primary and secondary production tubing 53A and 53B. Development and completion are carried out as with the monobore wellhead except that the spool tree 34A and tubing hanger 54A are elongated to accommodate lateral outlet ports 61A, 63A for the primary production fluid flow from a primary bore 80 in the tubing hanger to a primary production master valve 70A, and lateral outlet ports 62A, 64A for the secondary production fluid flow from a secondary bore 81 in the tubing hanger to a secondary production master valve 70B. The upper ends of the bores 80 and 81 are closed by wireline plugs 66A and 66B. A stopper 68A, which closes the upper end of the spool tree 34A has openings, in alignment with the plugs 66A and 66B, closed by wireline plugs 69A and 69B.

Figure 13:
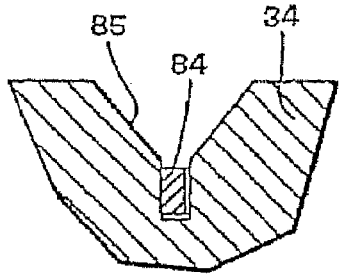
Figure 13A:
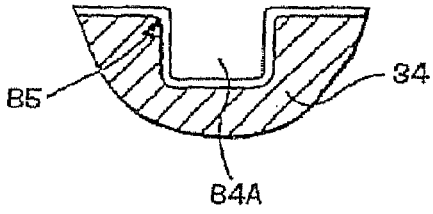
Figure 13B:
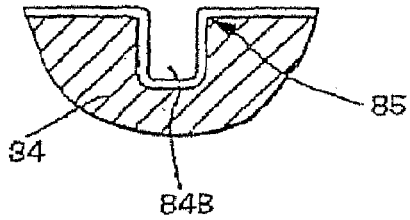
Figure 11:
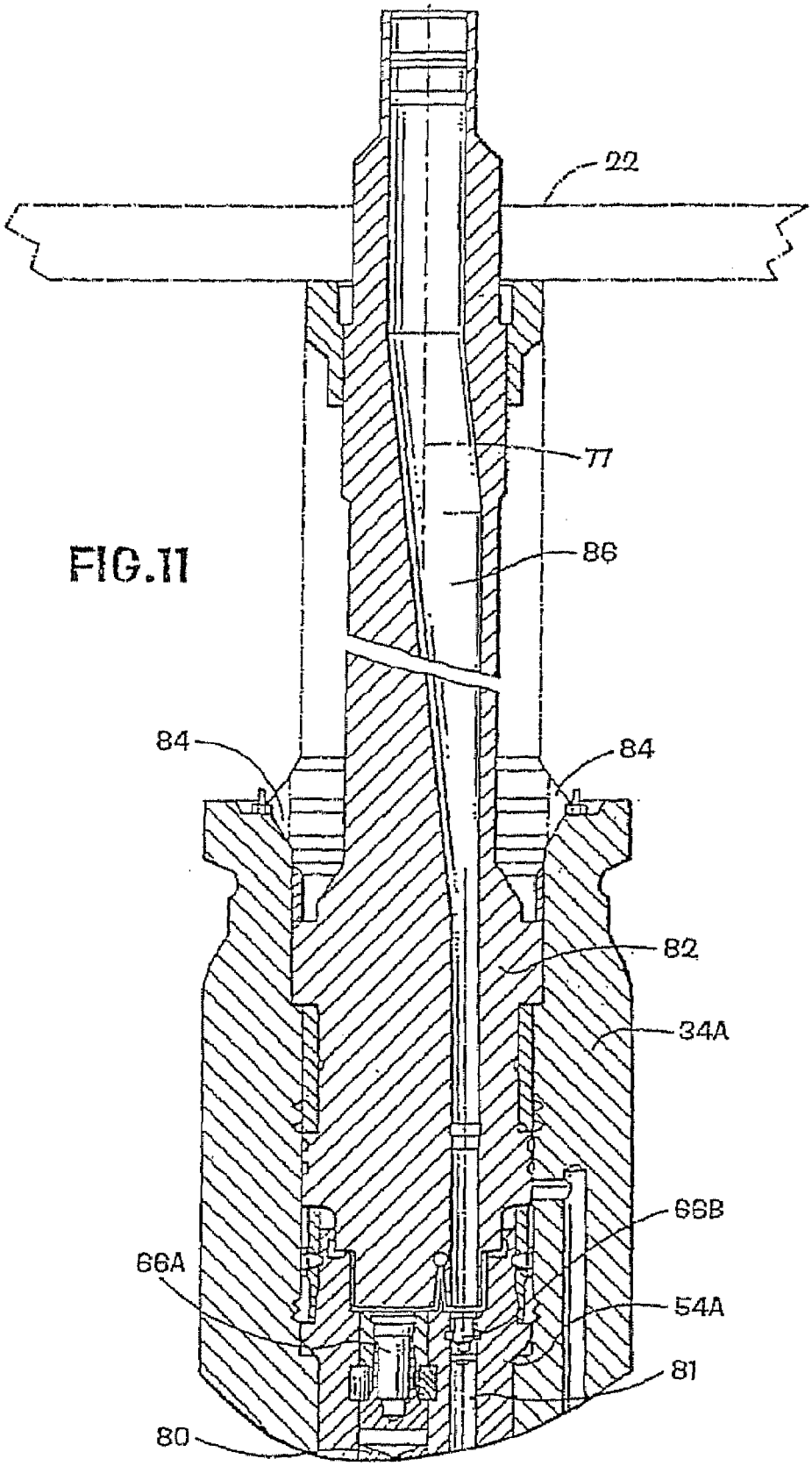
FIGS. 11 and 12 are vertical axial sections showing alternative connectors to the upper end of the dual production bore wellhead during work over; and, FIG. 13 is a detail showing the seating of one of the connectors in the spool tree.
Figure 12:
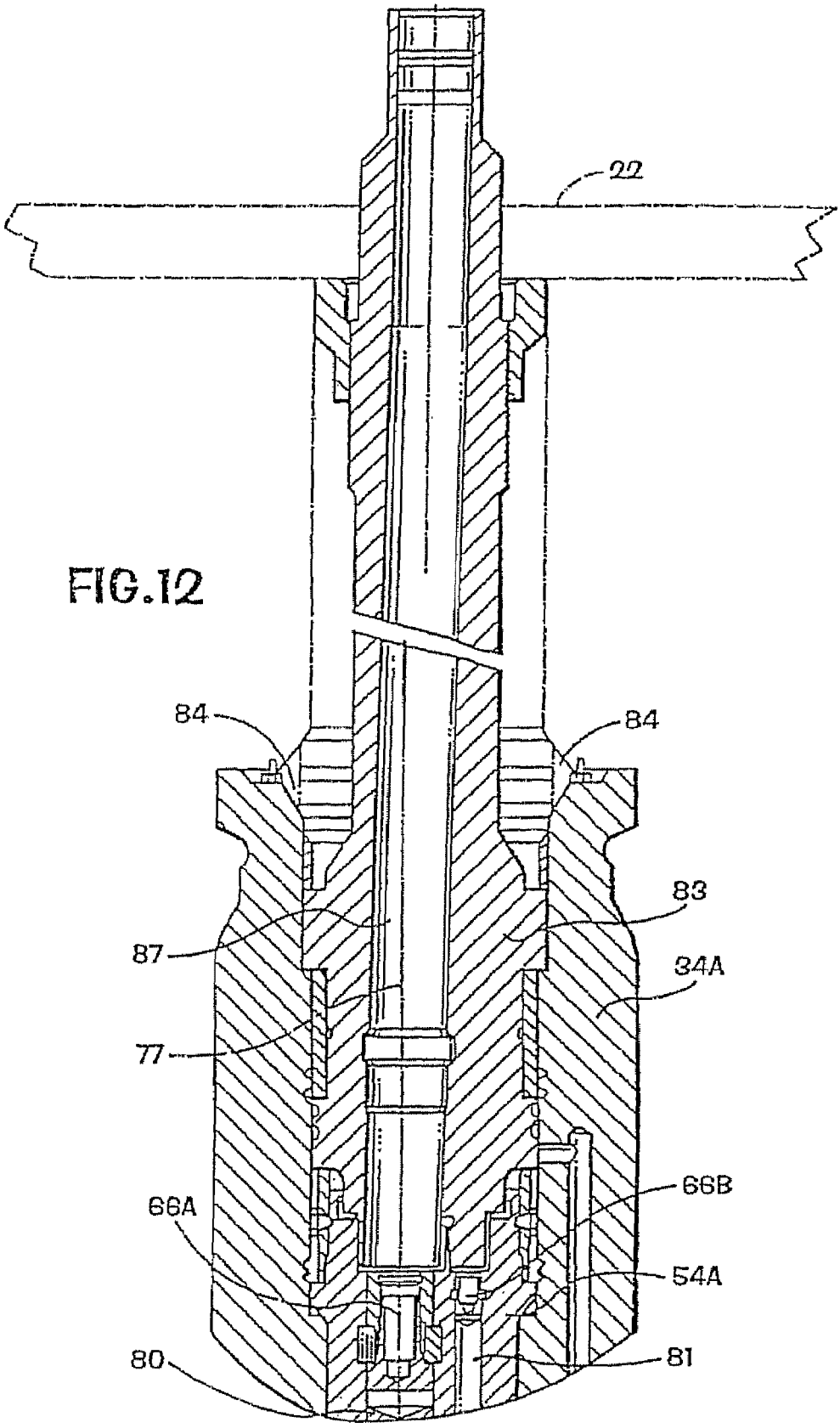

FIGS. 11 and 12 show how a wireline 77 can be applied through a single drill pipe to activate selectively one or other of the two wireline plugs 66A and 66B in the production bores 80 and 81 respectively. This involves the use of a selected one of two connectors 82 and 83. In practice, a drilling BOP 22 is installed and the stopper 68A is removed. Thereafter the connector 82 or 83 is run in on the drill pipe or tubing until it lands in, and is secured and sealed to the spool tree 34A. FIG. 13 shows how the correct angular orientation between the connector 82 or 83 and the spool tree 34A, is achieved by wing keys 84, which are guided by Y-shaped slots 85 in the upper inner edge of the spool tree, first to bring the connectors into the right angular orientation, and then to allow the relative axial movement between the parts to enable the stabbing function when the wireline connector engages with its respective pockets above plug 66A or 66B. To ensure equal landing forces and concentricity on initial contact, two keys 84A and 84B are recommended. As the running tool is slowly rotated under a new control weight, it is essential that the tool only enters in one fixed orientation. To ensure this key 84A is wider than key 843 and its respective Y-shaped slots. It will be seen that one of the connectors 82 has a guide duct 86 which leads the wireline to the plug 66B whereas the other connector 83 has a similar guide duct 87 which leads the wireline to the other plug 66A

What is claimed is:

1. In a subsea wellhead system having a wellhead housing secured to a first string of casing, a production casing hanger landed in the wellhead housing and secured to a production casing inside the first string of casing and extending below the production casing hanger to form a casing annulus, and a tree assembly that lands on the wellhead housing, the improvement comprising:

a port member releasably secured to the production casing hanger;

a casing annulus communication passage passing through a wall of the production casing hanger and communicating with the casing annulus; and the port member communicating with the casing annulus communication passage and having an open and closed position to open and close the casing annulus communication passage.

2. A wellhead assembly having a wellhead housing with a production casing hanger suspending production casing from the housing, the production casing forming a production casing annulus, the assembly comprising:

a spool tree to be fixed and sealed to the wellhead housing, and having at least a production casing annulus pressure monitoring port and a lateral production fluid outlet port;

an isolation sleeve to be sealed at its lower end to the production casing hanger and at its upper end to the spool tree to define an annular void between the isolation sleeve and the wellhead housing; and an adapter located in the annular void and providing part of a passage from the production casing annulus to the production casing annulus pressure monitoring port in the spool tree, the adapter having a valve for opening and closing the passage.

3. The wellhead assembly of claim 2 further including:

a tubing hanger landed within the spool tree at a predetermined angular position at which a lateral production fluid outlet port in the tubing hanger is in alignment with that in the spool tree;

the tubing hanger and spool tree having complementary guide means to rotate the tubing hanger into the predetermined angular position relatively to the spool tree as the tubing hanger is lowered onto its landing, the guide means being provided by complementary oblique edge surfaces, one facing downwards on an orientation sleeve depending from the tubing hanger and the other facing upwards on an orientation sleeve carried by the spool tree.

4. The wellhead assembly according to claim 2, in which the valve is provided by a gland nut, which can be screwed up and down within a body of the adapter to bring parts of the passage formed in the gland nut and adapter body, respectively, into and out of alignment with one another.

5. The wellhead assembly according to claim 2, wherein the valve is operable through the spool tree after withdrawal of the isolation sleeve up through the spool tree.

6. The wellhead assembly according to claim 2 with the housing having a bore and wherein the spool tree has a downwardly depending mandrel which is a close sliding fit within the bore of the housing.

7. The wellhead assembly according to claim 2, in which an environmental seal is provided between the spool tree and the housing, and a production seal is provided in series with the environmental seal between a location mandrel and either the wellhead housing or a production casing hanger.

8. A subsea well assembly for a cased well, the assembly comprising:

a wellhead housing landing in the cased well and having a string of outer casing extending therefrom;

at least one casing hanger landing in the wellhead housing which is secured to a string of inner casing, defining a casing annulus surrounding the inner casing;

a tree body adapted to be fixed and sealed to the wellhead housing;

a seal sleeve located around an upper portion of the casing hanger to sealingly connect the casing hanger with an interior wall of the wellhead housing;

a passage extending through the seal sleeve to the casing annulus;

the interior wall of the wellhead housing forming a passageway from the passage to a passageway outlet; and a casing annulus port in the tree body in communication with the passageway outlet of the passageway for monitoring the casing annulus pressure through the passage.

9. An apparatus for monitoring a casing annulus in a well, the casing annulus being formed by an outer casing supported by a wellhead housing and an inner casing suspended within the outer casing by a casing hanger, the casing hanger being supported by the wellhead housing, the apparatus comprising:

an adapter to be disposed on the casing hanger;

first seals on the adapter adapted to seal with the wellhead housing;

a tree body adapted to be fixed and sealed to the wellhead housing, said tree body having a tree body bore forming a wall with interior and exterior surfaces;

a mandrel extending between said tree body and said adapter;

second seals on the mandrel adapted to seal with the wellhead housing;

a port communicating between said interior and exterior surfaces; and a fluid passageway extending around said first and second seals for communicating the casing annulus with said port.

10. The apparatus of claim 9 wherein said port extends through said wall.

11. The apparatus of claim 9 wherein said passageway extends through said adapter and mandrel.

12. The apparatus of claim 11 wherein said adapter includes a valve to open and close that portion of said passageway passing through said adapter.

13. The apparatus of claim 9 wherein said port acts as a vent to relieve pressure in the easing annulus.

14. An apparatus for monitoring the flow of fluids in a well having an outer casing, comprising:

a wellhead supporting a casing hanger suspending an inner casing within the outer casing to form a casing annulus therebetween;

a mandrel connected to said wellhead and having a mandrel bore forming a mandrel wall;

a sleeve extending from said mandrel to said casing hanger;

said sleeve having mandrel end seals sealing with said mandrel and casing hanger end seals sealing with said casing hanger; and a fluid passageway extending around said casing hanger from said casing annulus to a mandrel duct in said mandrel wall.

15. The apparatus of claim 14 further including a casing annulus passageway extending from said mandrel duct to a casing annulus port through said mandrel wall.

16. The apparatus of claim 14 further including a valve controlling flow through said fluid passageway.

17. A wellhead comprising:

a wellhead housing;

a spool tree fixed and sealed to the housing;

a tubing hanger landed within the spool tree;

a production casing hanger carried in the housing below the spool tree and supporting casing that forms a production casing annulus around the casing;

a fluid pressure passage operably connecting said production casing annulus to a production casing annulus pressure monitoring port in the spool tree; and a valve for selective opening and closing of the passage.

18. An apparatus for controlling fluid flow in a subsea well having a subsea wellhead supporting an outer casing at the subsea floor, comprising:

a casing hanger suspended by the subsea wellhead at the subsea floor, said casing hanger being unsealed with the wellhead;

an inner casing having a bore and suspended within the subsea wellhead by said casing hanger, said inner casing forming a casing annulus with the outer casing;

a production mandrel connected to the wellhead and having an aperture forming a production mandrel wall and a production port adapted for fluid communication with a tubing hanger;

a casing annulus port extending through said mandrel wall;

said production mandrel sealed with said casing hanger to form a fluid passageway extending between said casing annulus and said casing annulus port; and fluid communication between said casing annulus and said casing annulus port via said fluid passageway.

19. The apparatus of claim 18 wherein a space is created between said wellhead, casing hanger and production mandrel.

20. The apparatus of claim 19 wherein a portion of said fluid passageway is formed between said space and said casing annulus.

21. An apparatus for controlling fluid flow in a well having an outer casing, comprising:

a wellhead suspending a casing hanger;

inner casing having a flow bore and suspended within said wellhead by said casing hanger, said inner casing forming a casing annulus with the outer casing;

a production mandrel connected to said wellhead and having a production mandrel bore forming a production mandrel wall;

a fluid passageway between said production mandrel bore and said casing annulus;

a casing annulus port extending through said production mandrel wall to said production mandrel bore;

fluid communication between said casing annulus and said casing annulus port via said fluid passageway; and a casing valve for controlling fluid flow between said casing annulus and said production mandrel bore.

22. An apparatus for controlling fluid flow in a well having an outer casing, comprising:

a wellhead suspending a casing hanger;

inner casing having a flow bore and suspended within said wellhead by said casing hanger, said inner casing forming a casing annulus with the outer casing;

a mandrel connected to said wellhead and having a mandrel bore forming a mandrel wall;

a fluid passageway between said mandrel bore and said casing annulus;

an annulus port extending through said mandrel wall to said mandrel bore;

fluid communication between said casing annulus and said annulus port via said fluid passageway;

a space being created between said wellhead, casing hanger and mandrel;

a portion of the fluid passageway being formed between said space and said casing annulus; and a casing valve for opening and closing said fluid passageway.

23. The apparatus of claim 22 wherein said casing valve includes an adapter mounted on said casing hanger and a reciprocable member movably mounted on said adapter, said member and adapter each having an annulus passageway with said member having an open position where said annulus passageways are in fluid communication and a closed position when said annulus passageways are not in fluid communication.

24. A wellhead system having a wellhead with an inner casing suspended within the wellhead and forming a casing annulus with an outer casing, comprising:

a mandrel disposed on the wellhead and having a vertical bore and a lateral production therethrough;

tubing insertable through said vertical bore and suspended within said mandrel and said inner casing, said tubing having a flowbore and forming a tubing annulus with said inner casing, said tubing flowbore being in communication with said lateral production bore;

a first valve on said mandrel for controlling flow through said tubing flowbore and said lateral production bore;

a flow passageway from said casing annulus to a casing annulus bore in said mandrel; and a second valve disposed in said flow passageway for controlling flow through said flow passageway.

25. An apparatus for controlling fluid flow in a subsea well having a subsea wellhead supporting an outer casing at the subsea floor, comprising:

a casing hanger suspended by the subsea wellhead at the subsea floor, said casing hanger being unsealed with the wellhead;

an inner casing having a bore and suspended within the subsea wellhead by said casing hanger, said inner casing forming a casing annulus with the outer casing;

a mandrel connected to the wellhead and having an aperture forming a mandrel wall and a production port adapted for fluid communication with a tubing hanger;

a casing annulus port extending through said mandrel wall to said aperture;

a member sealing with and extending between said mandrel and casing hanger to form a fluid passageway extending between said casing annulus and said casing annulus port;

fluid communication between said casing annulus and said casing annulus port via said fluid passageway; and a casing annulus valve for controlling flow through said fluid passageway and casing annulus port.

26. An apparatus for controlling fluid flow in a subsea well having a subsea wellhead supporting a casing string at the subsea floor, comprising:

a first hanger suspended by the subsea wellhead at the subsea floor, said first hanger being unsealed with the wellhead;

said first hanger supporting a first pipe string within the well, said first pipe string forming a first annulus with the casing sting;

a mandrel connected to the wellhead and having an aperture forming a mandrel wall having first, second, and third ports disposed in said wall;

a second hanger landed in said mandrel having first and second apertures in fluid communication with said first and second ports, respectively, said second hanger supporting a second pipe string within the well having a flow bate communicating with said first aperture and first port, said first and second pipe strings forming a second annulus;

said second aperture and second port communicating with said second annulus;

a first fluid flow path extending from the well and through the tubing flowbore, said first aperture and first port;

a second fluid flow path extending from the well and through said second annulus, said second aperture and second port; and a third fluid flow path extending from the well and through said first annulus and third port.

27. The apparatus of claim 26 further including a sleeve sealing with said mandrel below said second aperture and sealing with said first hanger, said sleeve forming passageways between said first annulus and said third aperture and between said second annulus and said second aperture.

* * * * *